US005410384A

United States Patent [19]

Wächtler

[11] Patent Number: 5,410,384

[45] Date of Patent: Apr. 25, 1995

[54] ELECTROPHOTOGRAPHIC SIMULTANEOUS DOUBLE PRINTING SYSTEM

[75] Inventor: Rudolf Wächtler, München, Germany

[73] Assignee: Siemens Nixdorf Informationssysteme Aktiengesellschaft, Paderborn, Germany

[21] Appl. No.: 204,223

[22] Filed: Mar. 3, 1994

[30] Foreign Application Priority Data

Sep. 3, 1991 [DE] Germany ..... 41 29 277.4

[51] Int. Cl.[6] ..... G03G 15/00

[52] U.S. Cl. ..... 355/23; 355/210; 355/272; 355/319

[58] Field of Search ..... 355/271, 272, 200, 210, 355/319, 24, 23

[56] References Cited

U.S. PATENT DOCUMENTS

| | | | |
|---|---|---|---|
| 2,990,278 | 6/1981 | Carlson . | |
| 3,212,399 | 10/1965 | Walter | 355/24 |
| 3,940,210 | 2/1976 | Donohue | 355/24 X |
| 4,052,128 | 10/1977 | Burton et al. | 355/23 X |
| 4,120,034 | 10/1978 | Fisk et al. | 355/319 X |
| 4,427,285 | 1/1984 | Stange . | |
| 4,477,176 | 10/1984 | Russel . | |
| 4,537,493 | 8/1985 | Russel . | |
| 4,552,449 | 11/1985 | Wakamatsu et al. . | |
| 5,021,836 | 6/1991 | van der Sterren et al. | 355/319 X |
| 5,179,417 | 1/1993 | Sugaya et al. | 355/319 |

FOREIGN PATENT DOCUMENTS

| | | | |
|---|---|---|---|
| 0154695 | 9/1985 | European Pat. Off. . | |
| 0222224 | 5/1987 | European Pat. Off. . | |
| 0392632 | 10/1990 | European Pat. Off. . | |
| 0478820 | 4/1992 | European Pat. Off. . | |
| 0195057 | 11/1982 | Japan | 226/197 |
| 61-117582 | 6/1986 | Japan . | |
| 2040226 | 8/1980 | United Kingdom . | |

OTHER PUBLICATIONS

"Method For Duplex Printing On Countinuous Web Paper", Xerox Disclosure Journal, vol. 9, No. 3, May/-Jun. 1984, pp. 201–203.

*Primary Examiner*—Matthew S. Smith

*Attorney, Agent, or Firm*—Hill, Steadman & Simpson

[57] ABSTRACT

The invention relates to a printing or copying device having a photoconductor drum (10) for receiving two adjacently arranged toner images for a recto and a verso of a recording medium (15). Provided for the simultaneous transfer of the toner images onto the recording medium (15) are two separate transfer ribbons for the recto toner image and the verso toner image. In this case, one transfer ribbon is deflected over a deflection device in such a way that the transfer ribbons (T1 and T2) are positioned one above the other in a fuser station (19) designed as a thermal printing fuser station. The recording medium (15) is passed between the transfer ribbons (T1 and T2) and is thus printed verso/recto simultaneously.

7 Claims, 2 Drawing Sheets

ELECTROPHOTOGRAPHIC SIMULTANEOUS DOUBLE PRINTING SYSTEM

BACKGROUND OF THE INVENTION

1. Field of the Invention

The invention relates to a printing or copying device having two transfer ribbons for the simultaneous printing of the verso and recto of a recording medium.

2. Description of the Related Art

Printing or copying devices of the type mentioned are known, for example, from U.S. Pat. Nos. 4,477,176 and 4,537,493. These relate to electrophotographic devices which have a photoconductor, on which at least two charge patterns can be arranged one after the other, and which have a transfer printing station with an associated single-sheet positioning device (turning device) which allows the electrophotographic printing device to be operated in two modes of operation, specifically in a first mode of operation, in which the applied toner images arranged one after the other on the charge pattern carrier are arranged one above the other or adjacently on one side of the single sheet, and a second mode of operation in which the sequence of the toner images located on the charge pattern carrier is arranged on the verso and recto of the single sheet. The fusing of the toner images on the single sheets takes place with the aid of a roller fuser station using pressure and high temperatures. In the mode of operation of duplex printing, in which a toner image is arranged on each side of the single sheet, the fusing of the verso and recto takes place simultaneously. For this purpose, the single sheet printed on one side has to be turned and printed again on the other side and it is then conveyed without contact to the roller fuser station, e.g. via an air cushion. This requires a very high mechanical expenditure if a high degree of operational reliability is to be guaranteed with a wide range of printing carriers.

A non-mechanical printing or copying device for multicolor and recto printing is known from European Patent application No. 0,154,695, which consists of a plurality of devices which are arranged one after the other and are operated simultaneously, a reversible deflection device for the paper web being arranged between the devices.

The connection of a plurality of complete printing systems one after the other is complex.

Furthermore, electrophotographic printing devices are known from U.S. Pat. No. 2,990,278 or Great Britain Patent application No. 2,040,226, in which charge patterns are produced character-dependently on a photoconductor with the aid of an exposure device and are fed to a developer station. The developed charge pattern is then lifted mechanically from the photoconductor by pressure with the aid of a ribbon-like transfer element and is transferred onto a recording medium. In order to be able to fuse the toner image on the recording medium, the toner image is heated on the, ribbon-like transfer element with the aid of a heating device, and the heated toner image is applied to the recording medium via a roller arrangement by pressure and heat. After the toner image has been transferred onto the recording medium, the intermediate carrier is cleaned from adhering toner in a cleaning station.

From the literature reference Patent Abstract of Japan, vol. 10, No. 300 (p 506); abstract of Japanese Patent application No. 61-117582, an electrophotographic single-sheet copying device for producing duplex printing is known. The copying device comprises a photoconductor drum on which verso and recto toner images are produced one after the other. Two transfer ribbons, which can be pivoted alternately against the photoconductor drum and are wrapped in each case around a heating roller, receive the verso and recto toner image. In this case, the heating rollers around which the transfer ribbons are wrapped are arranged so that they can be pressed onto one another, thus forming a transfer printing region. After the transfer of the toner images, the transfer ribbons are pivoted away from the photoconductor drum, and the toner images are simultaneously transferred onto a single sheet which is fed between the heating rollers.

SUMMARY OF THE INVENTION

An object of the invention is to provide a printing or copying device with which continuous two-sided printing of the recording medium is possible in one operation.

This and other objects and advantages are achieved in a printing or copying device having an intermediate carrier with an assigned recording and developer station for receiving a verso toner image assigned to a verso of a recording medium in a verso region and for receiving a recto toner image assigned to a recto of the recording medium in a recto region, the regions being arranged adjacently in the axial direction on the intermediate carrier, a transfer printing device having an upper and a lower deflection element, a verso transfer ribbon which is wrapped around the lower deflection element and is coupled with the verso region of the intermediate carrier, a recto transfer ribbon which is wrapped around the upper deflection element and is coupled with the recto region of the intermediate carrier, the recto transfer ribbon being guided over a deflection device, which laterally offsets the recto transfer ribbon, in such a way that the transfer ribbons are located opposite one another in the transfer printing device and thus simultaneously print the recording medium which is fed between the transfer ribbon's in the transfer printing device, and having means for fusing the toner images transferred onto the recording medium.

Advantageous further developments of the invention are provided by a printing or copying device having deflection elements which are rollers. In the transfer printing and fuser device which has rollers as the deflection elements, at least one of the rollers may be heated.

The printing or copying device may have a fuser device which is arranged downstream of the transfer printing device in the transporting direction of the recording medium including two fuser rollers which act on both sides of the recording medium, at least one of which is heated.

A further benefit is provided when a deflection device for the transfer ribbon, assigned to the verso transfer ribbon, for matching the conveying length of the transfer ribbon and as a mechanical intermediate storage for the toner images is provided. The transfer ribbons can be pivoted against and away from the intermediate carrier.

The printing or copying device has a deflection device for the recto transfer ribbon, the deflection device having: a feed deflection device and a return deflection device, each having deflection elements which are arranged at an angle to one another and which guide the transfer ribbon via its side to which no toner has been applied.

By using an intermediate carrier, for example a photoconductor drum, on which toner images assigned to the verso and recto of the recording medium are applied one after the other, and by arranging two transfer ribbons with appropriate deflection, the recording medium can be printed verso/recto simultaneously.

In this case, the device is suitable both for processing single sheets and continuous paper. Since only one printing system is required, the device is particularly economic and reliable. It can be operated at a high speed.. The recording medium passes through the thermal fusing station only once. The recording medium is thus subjected to only little thermal loading and is not deformed. The overall device is constructed to be compact and space-saving. The small printing interval when producing the verso and recto toner images results in a small storage requirement for the image production. Mechanical intermediate storage via an extension of the transfer ribbon is thus also possible.

BRIEF DESCRIPTION OF THE DRAWINGS

Embodiments of the invention are illustrated in the drawings and are described by way of example in greater detail below.

DETAILED DESCRIPTION OF THE PREFERRED EMBODIMENTS

Figure 1:
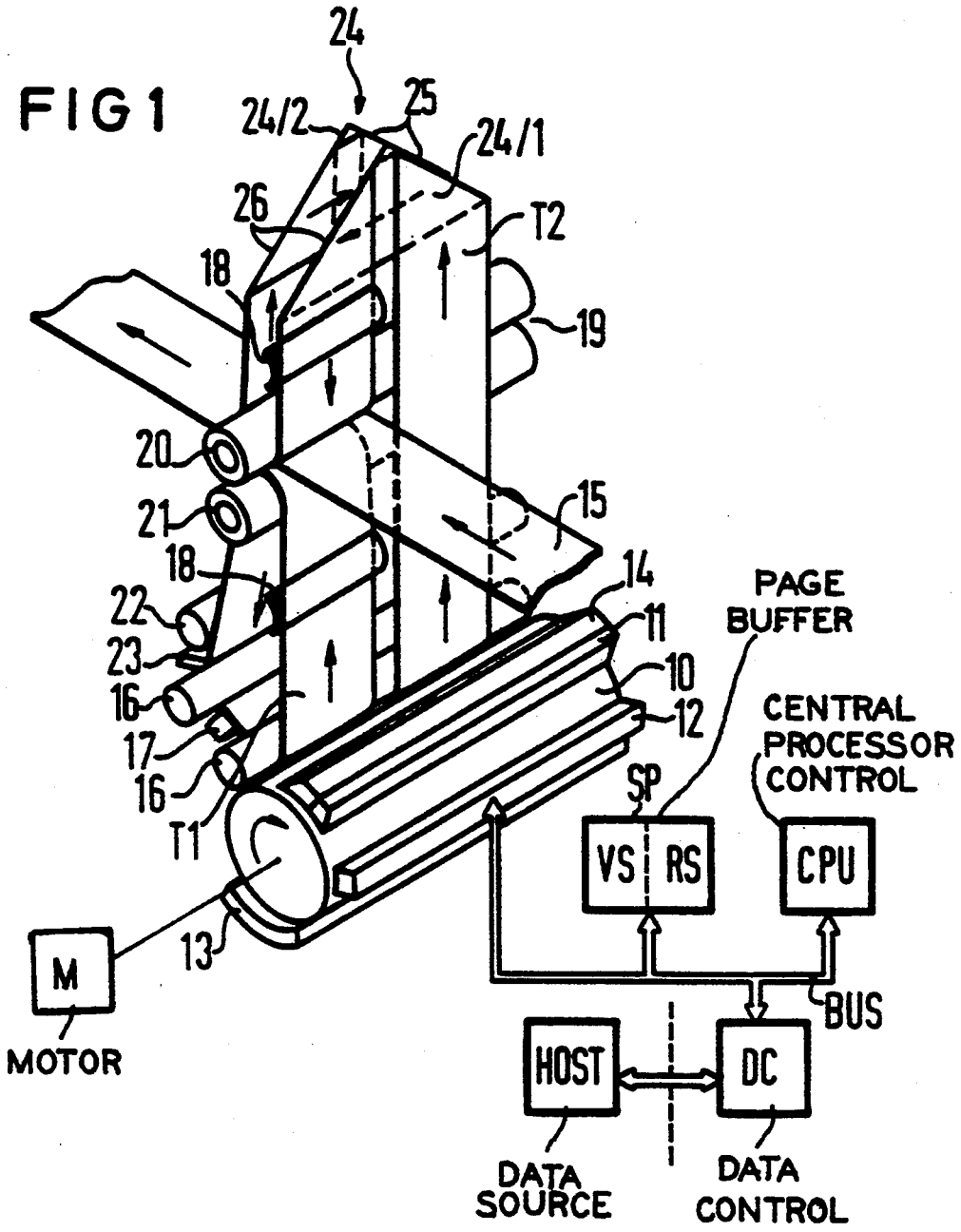
FIG. 1 shows a diagrammatic: illustration of an electrophotographic printing device for the simultaneous printing of the verso and recto of a recording medium

An electrophotographic printing device illustrated diagrammatically in FIG. 1 comprises a photoconductor drum as the intermediate carrier 10. However, instead of the photoconductor drum a ribbon-like intermediate carrier, e.g. an OPC ribbon, can also be used. The different units for the electrophotographic process are grouped around the intermediate carrier 10. These are essentially: a loading device 11 in the form of a loading corotron for charging the intermediate carrier 10; a character generator 12 having an LED comb for the character-dependent exposure of the intermediate carrier 10; a developer station 13 for applying toner to the charge pattern, discharged character-dependently, on the intermediate carrier 10. A cleaning station 14 is provided for removing the residual toner after development and transfer printing, the cleaning station having a cleaning brush integrated therein with an associated suction device and a discharging device. The intermediate carrier 10 (here shown as photoconductor drum) is driven by an electric motor m and is moved in the direction of the arrow during printing operation.

Furthermore, the printing device comprises two transfer ribbons T1 and T2 which are arranged adjacently and serve the purpose of transferring toner images produced on the photoconductor 10 onto a recording medium 15. The transfer ribbons T1 and T2 can consist of a-heat-resistant carrier fabric, e.g. of glass fibers or similar materials with an elastic covering layer made of an elastomer arranged thereon. In this case they are guided in such a way that the elastic covering layer faces the intermediate carrier 10. Both transfer ribbons T1 and T2 are driven by an electric motor and are designed so that they can be pivoted against and away from the photoconductor drum 10. In the exemplary embodiment illustrated, they are pivoted against and away from the photoconductor drum together; however, it is also possible to design them to be pivoted against and away from the photoconductor drum separately. In order to bring about this pivoting against and away from the photoconductor drum, both transfer ribbons T1 and T2 are guided over two pivotably arranged guide rollers 16.

The transfer of the toner images produced on the intermediate carrier 10 onto the ribbon-like transfer elements T1 and T2 takes place in the exemplary embodiment illustrated by electrostatic transfer. However, it is also possible to produce this transfer purely mechanically by pressing on and rolling off. In the case of the electrostatic transfer, an electrostatic charging of the ribbon surface takes place immediately before the transfer region on the photoconductor drum 10 by means of a loading station 17 which can consist, for example, of a corotron. Owing to the essentially electrostatic transfer effect, only very small forces and contact zones are necessary between the photoconductor 10 (intermediate carrier) and the transfer ribbons T1 and T2. As a result, excessive heating of the photoconductor is avoided. The toner images thus transferred onto the transfer ribbons T1 and T2 are heated, for example, with the aid of an infrared heating device 18 until the sticky state of the toner images is reached. They are then transferred onto the recording medium 15 in a transfer printing and fuser station 19. The transfer printing and fuser station 19 serves both as a transfer printing station and as a fuser station. For this purpose, it comprises two rollers, namely an upper roller 20 and a lower roller 21. In this case, the transfer ribbon T1 serving for printing the verso of the recording medium 15 is guided over the lower roller 21 and the transfer ribbon T2 serving for printing the recto of the recording medium 15 is guided over the upper roller 20. The rollers 20 and 21 are mounted elastically and each have a heating device, e.g. in the form of a radiator. With correspondingly sufficient dimensioning, it is also possible to heat only one roller.

In order to be able to clean the transfer ribbons T1 and T2 from adhering residual toner after printing the recording medium 15, the transfer ribbons T1 and T2 are guided over cleaning rollers 22. A loading station 23 arranged downstream of the cleaning rollers 22 in the direction of movement of the transfer ribbons T1 and T2 discharges the transfer ribbons T1 and T2 before they are again brought to a defined loading state via the loading station 17.

With the electrophotographic printing device illustrated, it is now possible to print the verso and recto of a recording medium 15 simultaneously. In this case, the recording medium 15 can consist of a single sheet or of continuous paper. It should furthermore be noted that the concepts verso and recto are to serve solely as relative designations for the two sides of the recording medium 15, they are exchangeable.

For this purpose, the transfer ribbons T1 and T2 are arranged adjacently. The transfer ribbon T1 is assigned to the verso (in this case the underside) of the recording medium 15, and the transfer ribbon T2 is assigned to the recto (in this case the upper side) of the recording medium 15. In order that this simultaneous printing of the recording medium 15 can take place in the transfer printing and fuser station 19, the transfer ribbon T2 assigned to the recto is guided over a deflection device 24. The deflection device 24 consists of a feed deflection device 24/1 and a return deflection device 24/2. Both deflection devices 24/1 and 24/2 have two deflection elements 25 and 26 arranged at an angle to one another, the transfer ribbon T2 being guided over the deflection elements in such a way that only the non-toner-applying side of the transfer ribbon contacts the deflection elements. The deflection elements 25 and 26 can consist, for example, of rods or of movably mounted rollers. In respect of their radius, they should be dimensioned such that the toner adhering to the transfer ribbon T2 is not caused to crack off by a deflection angle which is too acute. In respect of the position of their deflection elements 25 and 26, the deflection elements 24/1 and 24/2 are designed such that the transfer ribbon T2 which is wrapped around the upper roller 20 is positioned precisely above the transfer ribbon T1 which is wrapped around the lower roller 21. The guiding of the transfer ribbons T1 and T2 causes both transfer ribbons T1 and T2 to move in the same direction (direction of the arrow) in the region of the transfer printing and fuser station 19 so that they can print the verso and recto of the recording medium 15 simultaneously. In this case, the recording medium 15 is fed through the transfer printing and fuser station in the direction of the arrow.

Due to the different transporting length of the transfer ribbons T1 and T2, it is necessary to produce the toner images assigned to the verso and recto of the recording medium on the transfer ribbons T1 and T2 at different points in time. This can take place with the aid of the printer control in accordance with the illustration of FIG. 1. In this case, the printer control consists diagrammatically of a central processing unit CPU, of a page buffer SP which is subdivided, for example, into a buffer region for the verso VS and a buffer region for the recto RS, and of a data control unit DC. All the units of the control are connected to one another and to the character generator 12 via a BUS system.

The production of the verso and recto toner images on the photoconductor drum 10 and thus on the transfer ribbons T1 and T2 takes place by appropriate data processing via the data control unit DC, the data starting from a data source (HOST), e.g. an external data memory, and being fed via an interface to the data control device DC. In this case, the data of the pages to be printed individually are stored in the page buffer SP, specifically, for example, separately according to verso VS and recto RS in appropriate buffer regions. If a sequence of recording media 15 is now to be printed, it is necessary, as a result of the different running times of the toner images arranged on the transfer ribbons T1 and T2 until they reach the transfer printing and fuser station 19, to produce the toner images for the recto and the verso on the intermediate carrier 10 in a temporally staggered manner. If it is assumed, for example that the length of the transfer ribbon for printing the verso is dimensioned such that a complete toner image of one page can be produced on the transfer ribbon T1 before the toner image reaches the transfer printing and fuser station 19, and if it is furthermore assumed that the transfer ribbon T2 is dimensioned in respect of its length between the transfer printing and fuser station 19 and the intermediate carrier 10 such that it can receive two toner images before the first toner image reaches the transfer printing and fuser station 19, it is necessary to produce the recto toner image for the first recording medium of the sequence of two supplied recording media 15 firstly via the intermediate carrier 10 on the transfer ribbon for the recto T2. The recto toner image for the second recording medium is then produced on the transfer ribbon T2 and, at the same time, the verso toner image for the first recording medium is produced on the transfer ribbon T1. Due to the temporal staggering of the toner image production on the intermediate carrier 10, the verso and recto toner images assigned to the respective recording media reach the transfer printing and fuser station 19 simultaneously and are there transferred simultaneously onto the appropriate recording medium 15.

Figure 2:
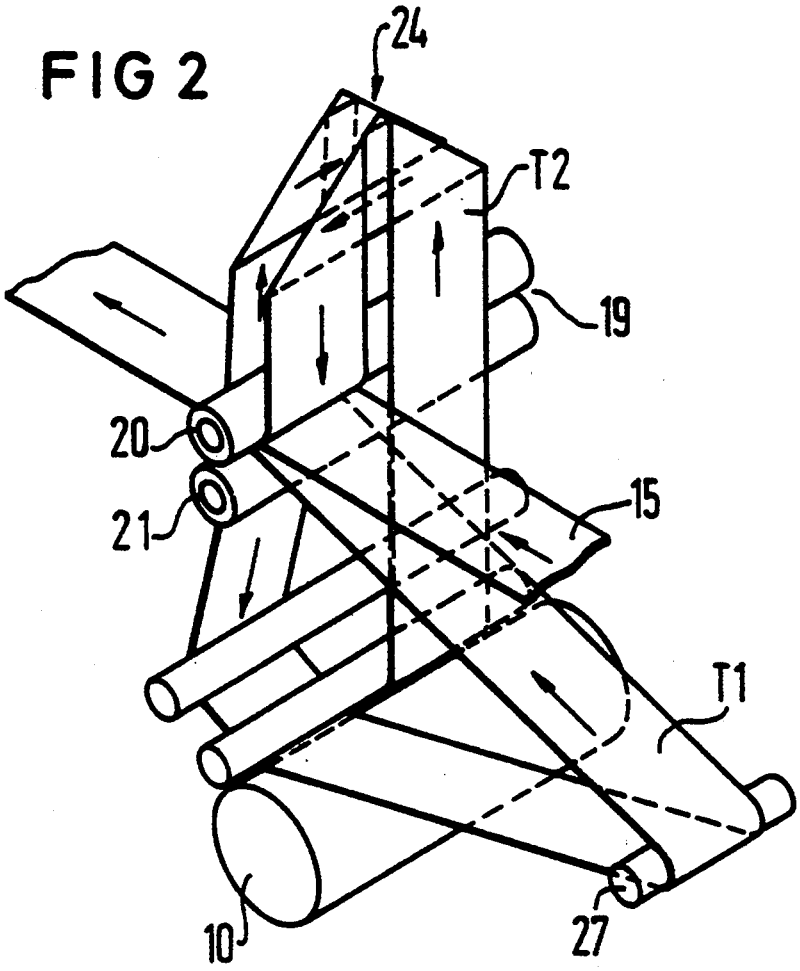
FIG. 2 shows a diagrammatic illustration of the same device having a deflection device which extends the transfer ribbon for the mechanical intermediate storage of the toner images.

This toner image synchronization can also be achieved in accordance with an exemplary embodiment of FIG. 2 in that the transfer ribbon T1 is deflected correspondingly via a deflection roller 27 and thus matches the conveying length of the transfer ribbon for the verso T1 between the intermediate carrier 10 and the transfer printing and fuser station 19 to the conveying length of the transfer ribbon for the recto T2 between the intermediate carrier 10 and the transfer printing and fuser station 19. In this case, simultaneous production of the toner images for the verso and recto of an assigned recording medium on the photoconductor drum 10 is possible. A temporally staggered processing of the data for the individual toner images to be produced via the control of the device is not necessary in this case.

In the exemplary embodiment of the electrophotographic printing device illustrated in FIGS. 1 and 2, a combined transfer printing and fuser station 19 is used. However, it is also possible to separate the fuser station from the transfer printing station. In this case, the rollers 20 and 21 would serve as unheated, rotatable roller is solely for the transfer printing of the toner images on the recording medium. An additional fuser station arranged downstream in the transporting direction of the paper (arrow) would then be necessary for fusing the transferred toner images on the recording medium. This fuser station could likewise be designed as a thermal printing fuser station or consist, for example, of a high-speed fuser station or a thermal fuser station.

Furthermore, instead of the rotatable rollers 20 and 21, it is conceivable to use deflection elements in the form of resiliently mounted, highly polished semi-shells or similar elements.

Although other modifications and changes may be suggested by those skilled in the art, it is the intention of the inventor to embody within the patent warranted hereon all changes and modifications as reasonably and properly come within the scope of his contribution to the art.

| List of reference numerals | |
|---|---|
| 10 | Intermediate carrier, photoconductor drum |
| 11 | Loading device, corotron |
| 12 | Character generator |
| 13 | Developer station |
| 14 | Cleaning station |
| T1 | Transfer ribbon (verso, verso transfer ribbon) |
| T2 | Transfer ribbon (recto, recto transfer ribbon) |
| 15 | Recording medium (continuous paper, single sheets) |
| 16 | Guide rollers |
| 17 | Loading station |
| 18 | Infrared heating device |
| 19 | Transfer printing and fuser station, transfer printing station |

-continued

| List of reference numerals | |
|---|---|
| 20 | Upper roller, upper deflection element |
| 21 | Lower roller, lower deflection element |
| 22 | Cleaning roller |
| 23 | Loading station |
| 24 | Deflection device |
| 24/1 | Feed deflection device |
| 24/2 | Return deflection device |
| 25, 26 | Deflection element |
| CPU | Central processing unit |
| SP | Page buffer |
| DC | Data control device |
| BUS | Data bus system |
| HOST | Data source, external EDP |
| 27 | Deflection roller, deflection element |

I claim:

1. A printing or copying device comprising:

an intermediate carrier with an assigned recording and developer station for receiving a verso toner image assigned to a verso of a recording medium in a verso region and for receiving a recto toner image assigned to a recto of the recording medium in a recto region, said verso and recto regions being arranged adjacently in an axial direction on said intermediate carrier, a transfer printing device having an upper and a lower deflection element, a verso transfer ribbon wrapped around said lower deflection element and coupled with said verso region of said intermediate carrier, a recto transfer ribbon wrapped around said upper deflection element and coupled with said recto region of said intermediate carrier, said recto transfer ribbon being guided over a deflection device, which laterally offsets said recto transfer ribbon, in such a way that said verso and recto transfer ribbons are located opposite one another in the transfer printing device and thus simultaneously print the recording medium which is fed between said verso and recto transfer ribbons in said transfer printing device, and means for fusing toner images transferred onto said recording medium.

2. A printing or copying device as claimed in claim 1, wherein said deflection elements are rollers.

3. A printing or copying device as claimed in claim 1, further comprising:

a transfer printing and fuser device which has rollers as deflection elements, at least one of said rollers being heated.

4. A printing or copying device as claimed in claim 1, wherein said means for fusing includes a fuser device arranged downstream of said transfer printing device in the transporting direction of said recording medium and has two fuser rollers which act on both sides of said recording medium, and at least one of said two fuser rollers being heated.

5. A printing or copying device as claimed in claim 1, further comprising:

a deflection device for said verso transfer ribbon, for matching a conveying length of said verso transfer ribbon to said recto transfer ribbon and as a mechanical intermediate storage for the toner images.

6. A printing or copying device as claimed in claim 1, further comprising:

means for pivoting said transfer ribbons against and away from said intermediate carrier.

7. A printing or copying device as claimed in claim 1, further comprising:

a deflection device for said recto transfer ribbon, said deflection device having: a feed deflection device and a return deflection device, each having deflection elements which are arranged at an angle to one another and which guide said transfer ribbon via its side to which no toner has been applied.

* * * * *

UNITED STATES PATENT AND TRADEMARK OFFICE

CERTIFICATE OF CORRECTION

PATENT NO. : 5,410,384

DATED : April 25, 1995

INVENTOR(S) : Rudolf Wächtler

It is certified that error appears in the above-indentified patent and that said Letters Patent is hereby corrected as shown below:

On the cover page: Item [22] [86] and [87] as follows:

| | | |
|---|---|---|
| [22] | PCT Filed: | August 27, 1992 |
| [86] | PCT No.: | PCT/DE92/00716 |
| | §371 Date: | March 3, 1994 |
| | §102(e) Date: | March 3, 1994 |
| [87] | PCT Pub. No.: | WO93/05447 |
| | PCT Pub. Date: | March 18, 1993 |

Signed and Sealed this

Twenty-ninth Day of August, 1995

*Attest:*

BRUCE LEHMAN

*Attesting Officer*

*Commissioner of Patents and Trademarks*